United States Patent [19]

Herres

[11] Patent Number: 4,745,341

[45] Date of Patent: May 17, 1988

[54] RAPID RESTRIKE STARTER FOR HIGH INTENSITY DISCHARGE LAMPS

[75] Inventor: Donald C. Herres, Syracuse, N.Y.

[73] Assignee: Cooper Industries, Houston, Tex.

[21] Appl. No.: 54,060

[22] Filed: May 26, 1987

Related U.S. Application Data

[63] Continuation-in-part of Ser. No. 843,548, Mar. 25, 1986, abandoned.

[51] Int. Cl.[4] ..... H05B 37/00

[52] U.S. Cl. ..... 315/176; 315/246; 315/276; 315/290; 315/DIG. 2

[58] Field of Search ..... 315/176, 246, 276, 290, 315/DIG. 2

[56] References Cited

U.S. PATENT DOCUMENTS

| | | | |
|---|---|---|---|
| RE. 31,486 | 1/1984 | Helmuth | 315/205 |
| 3,235,769 | 2/1966 | Wattenbach | 315/176 |
| 3,522,475 | 8/1970 | Hashimoto | 315/239 |
| 3,544,839 | 12/1970 | Fahnrich | 315/200 R |
| 3,681,653 | 8/1972 | Snyder | 315/176 |
| 3,699,385 | 10/1972 | Paget | 315/239 |
| 3,758,818 | 9/1973 | Kaneda | 315/290 |
| 4,342,948 | 8/1982 | Samuels | 315/289 |
| 4,356,433 | 10/1982 | Linden | 315/308 |
| 4,527,098 | 7/1985 | Owen | 315/290 |
| 4,678,968 | 7/1987 | Lester | 315/DIG. 2 |
| 4,683,404 | 7/1987 | Hitchcock | 315/276 |

*Primary Examiner*—Harold Dixon

*Attorney, Agent, or Firm*—E. E. Scott; R. L. Maxwell

[57] ABSTRACT

In a rapid restrike starter embodying the invention, a starting circuit applies a series of high voltage pulses, each of approximately the same magnitude through a transformer in series with the ballast and the high intensity discharge lamp to be started, a voltage triggered switch such as a sidac is used to turn the starting circuit on at a predetermined voltage, a second voltage triggered switch connected in series with the first acts in conjunction with a circuit comprised of capacitors and resistors to cause a series of resonant symmetric pulses each approximately the same magnitude as the initial pulse, the use of this oscillating pulse provides restrike performance at approximately two-thirds the pulse voltage otherwise required which improves long term reliability by decreasing the likelihood of socket arcing and insulation breakdown.

5 Claims, 2 Drawing Sheets

RAPID RESTRIKE STARTER FOR HIGH INTENSITY DISCHARGE LAMPS

This is a continuation-in-part of application Ser. No. 843,548, filed on Mar. 25, 1986, now abandoned.

BACKGROUND OF THE INVENTION

1. Field of the Invention

This invention relates in general to starting of gas discharge lamps and more particularly, to rapid restarting of high pressure sodium lamps.

2. Background

Some high intensity discharge (HID) lamps utilizing metal vapors as the discharge medium require a starting voltage much higher than the operating voltage and this is particularly so with high pressure sodium (HPS) vapor lamps. For such lamps, starting aids have become available which are combined with otherwise conventional ballasts to generate a series of high frequency pulses which initiate the breakdown in the lamp.

The high pressure sodium lamp uses xenon as a starting gas because it will start conducting more easily than sodium vapor. When the lamp is cool, a standard starting pulse, about 2.5 kilo volts (KV), ionizes the xenon which causes the lamp to conduct. When the lamp is hot, after continuous operation, the sodium has vaporized which increases pressure in the lamp. A normal starting pulse will not restart the hot lamp because the vaporized sodium gas is not ionized as easily as xenon. As the lamp cools, the vapor pressure of sodium decreases and relative concentration of xenon increases. A lamp with a standard starter must cool for about one minute before it will restart. Pulses from the starter while the lamp cools will have no effect.

HPS lamps can be restarted while hot but it requires a higher voltage pulse to do so. The high pressure sodium lamp requires a pulse of about 7 KV to restrike a hot lamp. The definition of what constitutes a rapid restrike depends on the manufacturer but typically a hot lamp may take from 0 to 40 second to restrike or restart depending on the pulse voltage, waveshape, and the lamp characteristics.

There are several rapid restrike devices currently available. One such device described in U.S. Pat. No. 4,527,098—Owens, Discrete Starter for HID Lamp, uses a sidac as a voltage trigger which discharges a capacitor into the windings of a transformer which then produces a high voltage pulse. The transformer isolates the pulse from the ballast. A power resistor in this design is an undesirable additional heat source.

Another rapid restrike device is described in U.S. Pat. No. RE 31,486—Helmuth, Rapid Starting of Gas Discharge Lamps. This restrike device is comprised of a solid state circuit triggered when the ballast output is 120 volts RMS with the lamp off. An output pulse is formed by a capacitor discharging into the primary of a transformer which has a high turns ratio so that high voltage pulses are formed. There are two transformer secondary windings, one on each lamp lead and both the lamp socket and the lamp shell are pulsed. An electron gun is also used as a source of ionization. This configuration generates such a great amount of heat that it requires a thermal cutout. The thermal cutout will sometimes interrupt restrike pulses delaying restarting of the lamp.

An additional problem with some prior art rapid restrike devices is that the capacitors used for the restart circuit remain in the circuit during operation of the lamp. This creates a problem in that it causes spikes on the leading edge of the square wave generated by the ballast which can lead to shorter lamp life.

It is, therefore, an object of the present invention to provide an improved rapid restrike starter which removes the starting capacitance during operation of the lamp.

SUMMARY OF THE INVENTION

In a rapid restrike starter embodying the invention, a starting circuit applies a series of high voltage pulses, each of approximately the same magnitude through a transformer in series with the ballast and the high intensity discharge lamp to be started. A voltage triggered switch such as a sidac is used to turn the starting circuit on at a predetermined voltage. A second voltage triggered switch connected in series with the first acts in conjunction with a circuit comprised of capacitors and resistors to cause a series of resonant symmetric pulses each approximately the same magnitude as the initial pulse. The use of this oscillating pulse provides restrike performance at approximately two-thirds the pulse voltage otherwise required which improves long term reliability by decreasing the likelihood of socket arcing and insulation breakdown.

DETAILED DESCRIPTION OF THE INVENTION

Figure 1:
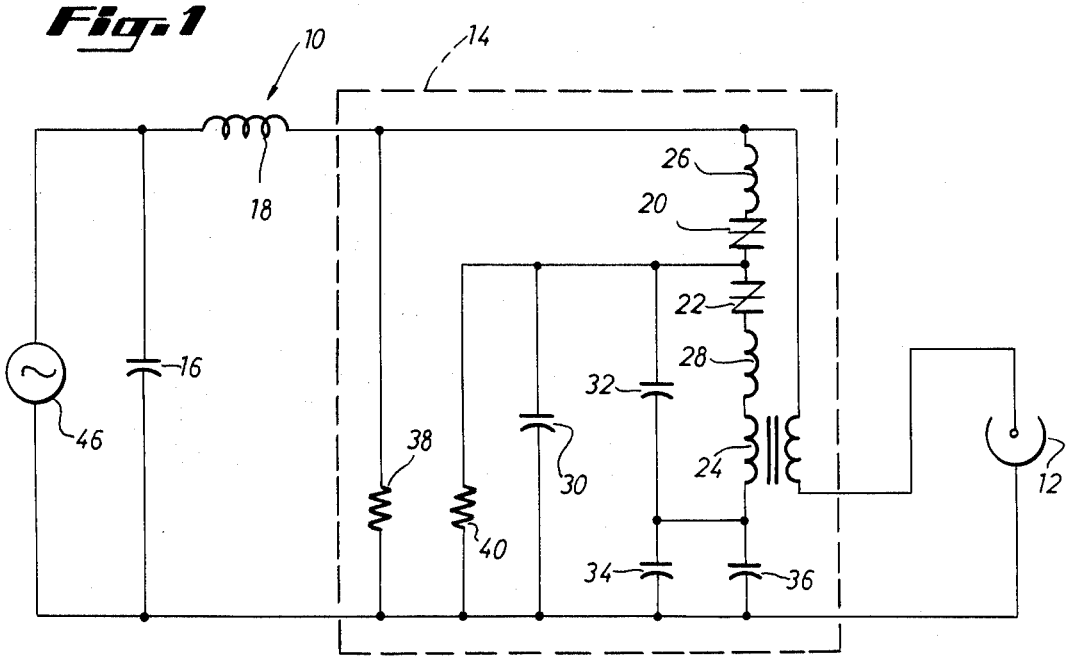
FIG. 1 is a schematic of a series ballast lamp and operating circuit including the rapid restrike starter of the invention.

The starter 14 has a first voltage triggered switch 20 which conducts at an input voltage greater than 120 volts. A second voltage triggered switch 22 in series with the first conducts at a higher voltage, preferably greater than 158 volts, due to a voltage divider circuit. These two voltage triggered switches are connected in series with the primary of a transformer 24. Transformer 24 has a high turns ratio so that when voltage triggered switches 20 and 22 are conducting, a high voltage pulse is induced across lamp 12 which is in series with secondary of transformer 24.

First inductor 26 and second inductor 28 are connected in series with voltage triggered switches 20 and 22 to limit the rise of current over time. This improves long term reliability of the circuit. Another function of inductor 28 is to cause a resonant pulse. This oscillating pulse provides restrike performance with approximately two-thirds the pulse voltage otherwise required. This improves long term reliability by decreasing the likelihood of socket arcing and insulation breakdown.

A first capacitor 36 is in series with first and second voltage triggered switches 20 and 22, first and second inductors 26 and 28 and the primary of transformer 24. A second capacitor 30 is in parallel with second voltage triggered switch 22, second inductor 28, first capacitor 36 and the primary of transformer 24. The purpose of second capacitor 30 is to increase the magnitude of the pulse when it occurs. A third capacitor 32 is in parallel with second voltage triggered switch 22, second inductor 28 and the primary of transformer 24. A fourth capacitor 34 is in series with third capacitor 32 and in parallel with first capacitor 36.

A first resistor 38 is in parallel with first and second voltage triggered switches 20 and 22, first and second inductors 26 and 28, first capacitor 36, and the primary of transformer 24. This first resistor is necessary to discharge the power correction factor capacitor 16 when the voltage supply is disconnected. A second resistor 40 is in parallel with second voltage triggered switch 22, second inductor 28, first capacitor 36 and the primary of transformer 24. Second resistor 40 discharges some of the voltage that builds up on capacitors 32, 34 and 36 when voltage triggered switches 20 and 22 stop conducting so that subsequent pulses occur throughout the sine wave in an asynchronous manner.

Voltage is supplied to circuit 10 by a conventional voltage source indicated schematically by voltage source 46.

By way of example only, a circuit such as shown in FIG. 1 could be constructed of components having designations or values as listed below in an application with a 55 volt arc tube high pressure sodium lamp.

| | |
|---|---|
| Z (20) | Any of numerous commercially available sidacs, diacs and quadracs such as Teccor Electronic, Inc.'s Sidac K1200E or K1200U |
| Z (22) | Any of numerous commercially available sidacs, diacs and quadracs such as Teccor Electronic, Inc.'s Sidac K1200E or K1200U |
| L (26) | 10 Microhenry's |
| L (28) | 4.7 Microhenry's |
| C (30) | 1.0 mfd |
| C (32) | 1.0 mfd |
| C (34) | 1.0 mfd |
| C (36) | 2.2 mfd |
| R (38) | 470 Kohm |
| R (40) | 5.6 Kohm |
| Transformer (24) | Pulse Transformer with a turns ratio of 1:55 |

It should be readily apparent to those skilled in the art that the above-described circuit uses a voltage triggered switch to keep the circuitry at neutral voltage during operation, uses an inductor to create an oscillatory starting pulse with several resonant peaks and uses capacitors to isolate the pulses from neutral. More specifically with regard to operation of the circuit of FIG. 1 having components as identified above, when the input voltage is applied with lamp 12 off, first voltage triggered switch 20 can be selected to conduct at an input voltage greater than 120 volts. This would occur when the input is greater than 45° on the sine wave. Second voltage triggered switch 22 can be selected to conduct when the input voltage is greater than 158 volts at about 68°. A pulse would be generated across the primary of transformer 24 when second voltage triggered switch 22 conducts which would result in a high voltage pulse at the lamp 12 because of the high turns ratio of the transformer 24. The first and second voltage triggered switches 20, 22 would stop conducting near the peak of the sine wave because the current would be at a minimum at that point. Without resistor 40, subsequent pulses would occur near the zero crossing point on the sine wave because when the voltage triggered switches 20, 22 stop conducting, capacitors 32, 34, 36 would be charged to near the peak voltage. The function of resistor 40 is to discharge some of this voltage so that subsequent pulses appear throughout the sine wave without synchronization. Pulses must occur when this input sine wave is between 65° and 110° or 240° and 290° for the lamp to turn on.

Inductors 26 and 28 limit the current rise over time on voltage triggered switches 20 and 22 respectively. This improves long term reliability of the circuit. A second major function of inductor 28 is to cause a resonant pulse. The pulse peak is plus or minus 12 kilovolts and is a damped oscillation with 5 subsequent peaks greater than plus or minus 5 kilovolts. The behavior is symmetric. This oscillating pulse provides restrike performance with approximately two-thirds the pulse voltage otherwise required. This improves long term reliability by decreasing the likelihood of socket arcs and insulation breakdown. Capacitor 30 acts to increase the magnitude of the pulse when it occurs.

When the lamp is on, the ballast output drops to a 55 volt square wave. The square wave has an overshoot to 80 volts on the leading edge. Voltage triggered switch 20 functions to block this voltage from capacitors 30, 32, 34 and 36. These capacitors have a combined capacitance of 1.76 microfarads. Without voltage triggered switch 20, this would form an LC oscillatory circuit which causes the leading edge voltage to rise to 120 volts. This would cause voltage triggered switch 22 to conduct during lamp operation which is undesirable. Resistor 40 discharges capacitor 32 so that there is not a stored voltage which would cause voltage triggered switch 20 to conduct with the lamp on.

Resistor 38 is necessary for use with the reactor ballast as shown in FIG. 1. The power correction capacitor can be charged up to 170 volts when the power is disconnected. Resistor 38 bleeds this charge off in accordance with the requirements of UL 1572. Those requirements and all other details of the operation of the circuit of FIG. 1 and its variations as described below should be known or readily knowable and completely understandable to those of ordinary skill in the relevant art.

Figure 2:
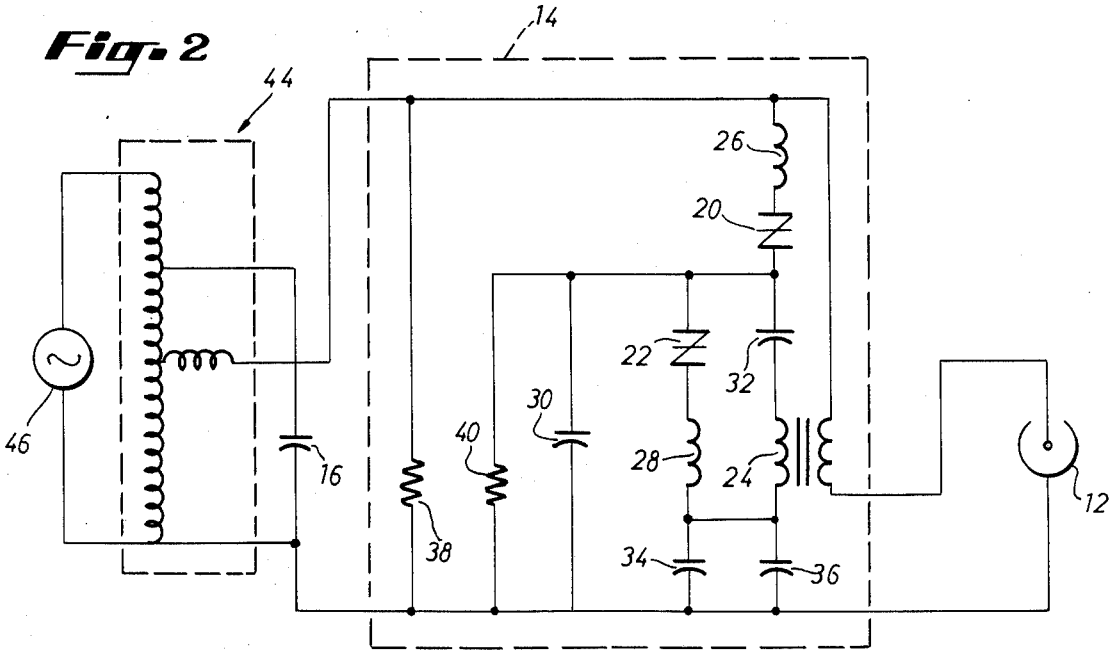
FIG. 2 is a schematic diagram of an alternate embodiment of a series ballast and lamp employing a rapid restrike starter of the invention.

FIG. 2 shows an alternate embodiment of the rapid restrike starter wherein the position in the circuit of third capacitor 32, and second voltage triggered switch 22 and second inductor 28, have been reversed. Thus, third capacitor 32 operates in parallel with first voltage triggered switch 20, first inductor 26, the primary of transformer 24 and first capacitor 36. Second voltage triggered switch 22 and second inductor 28 are in series with fourth capacitor 34 and parallel to third capacitor 32 and the primary of transformer 24. Otherwise, this starting circuit is essentially the same as that shown in FIG. 1.

In FIG. 2, the reactor ballast 18 has been replaced by an autotransformer ballast such as is well known in the art.

Figure 3:
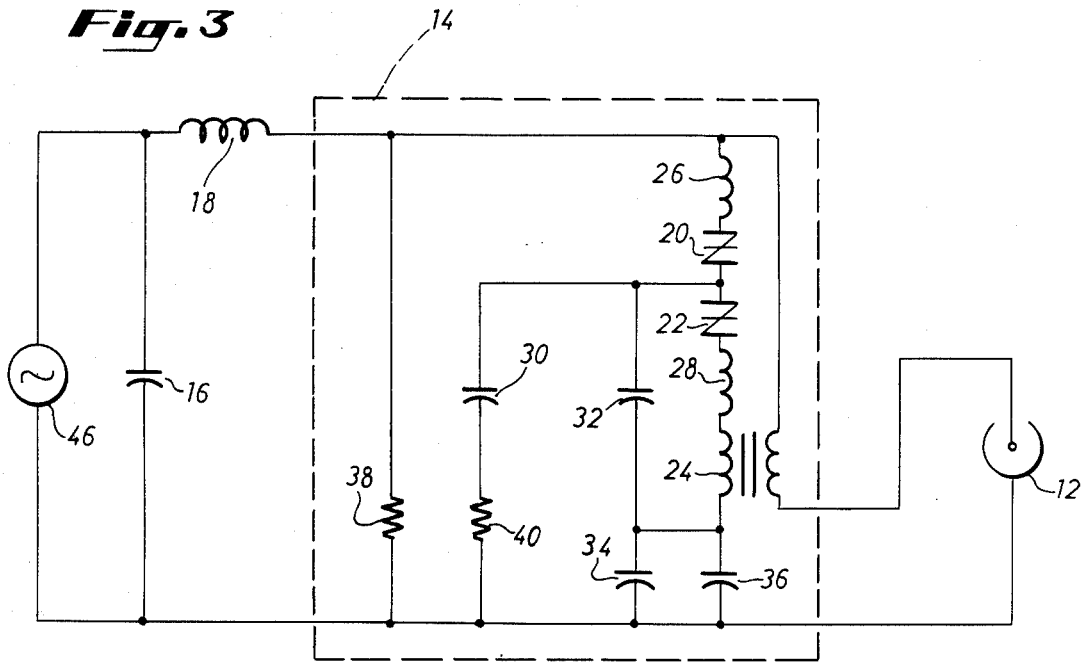
FIG. 3 is a schematic diagram of a series ballast and lamp operating circuit including a further embodiment of a rapid restrike starter according to the invention.

FIG. 3 shows an alternate embodiment of the rapid restrike starter which is identical to FIG. 1 except that resistor 40 and capacitor 30 are in series and not in parallel. Thus, capacitor 30 and resistor 40 are in series with inductor 26 and voltage triggered switch 20 and in parallel with voltage triggered switch 22, inductor 28, the primary of transformer 24, and capacitor 36.

Figure 4:
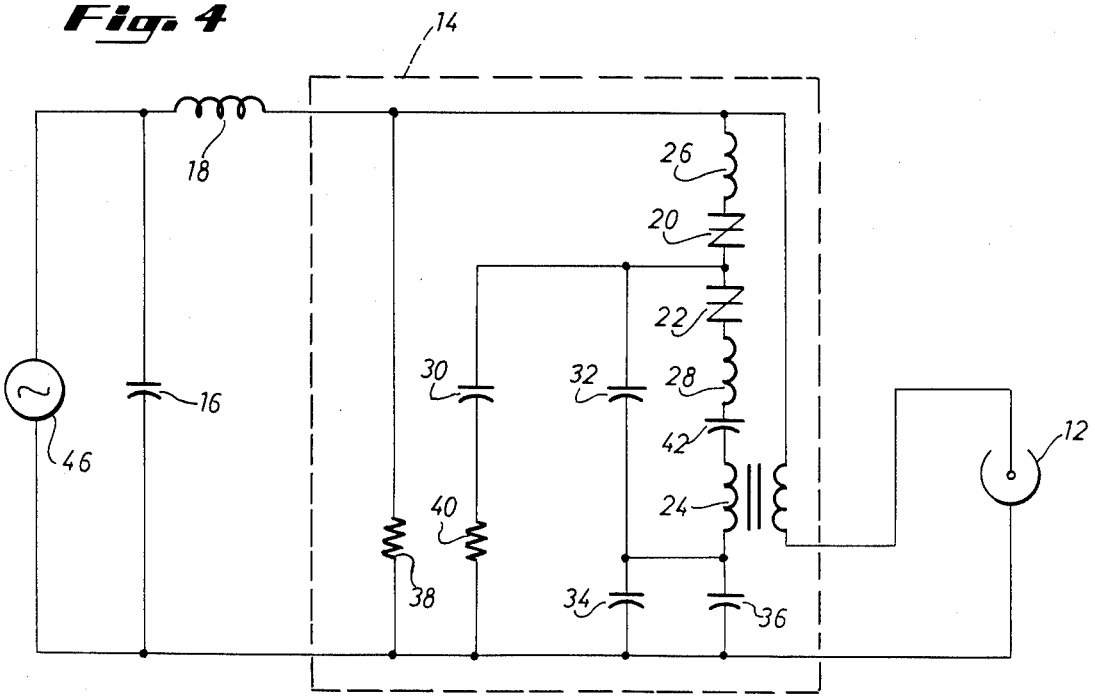
FIG. 4 is a schematic diagram of another embodiment of a series ballast and lamp operating circuit including a rapid restrike starter according to the invention.

FIG. 4 shows an alternate embodiment of the rapid restrike which is identical to FIG. 3 except that a capacitor 42 has been added in series with voltage triggered switch 22, inductor 28, and the primary of transformer 24. Thus voltage triggered switch 22, inductor 28, capacitor 42, and the primary of transformer 24 are in series with the voltage triggered switch 20 and inductor 26, and with capacitor 36, and are in parallel with capacitor 32.

I claim:

1. A rapid restrike starter for starting a high intensity discharge lamp by high voltage pulses comprising:

a pulse transformer, the secondary of which is connected in series with the lamp and a ballast;

a first voltage triggered switch connected in series with the primary of said pulse transformer;

a second voltage triggered switch connected in series with said first voltage triggered switch and the primary of said pulse transformer;

a first inductor connected in series with said first and said second voltage triggered switch and the primary of said pulse transformer;

a second inductor connected in series with said first and said second voltage triggered switch, said first inductor means and the primary of said pulse transformer;

a first capacitor connected in series with said first and second voltage triggered switch, said first and second inductor means and the primary of said pulse transformer;

a second capacitor connected and parallel with said second voltage triggered switch, said second inductor, said first capacitor and the primary of said pulse transformer; and a third capacitor connected in parallel with said second voltage triggered switch and said second inductor and the primary of said pulse transformer.

2. A rapid restrike starter as in claim 1 wherein a fourth capacitor is connected in series with said third capacitor and parallel to said first capacitor.

3. A rapid restrike starter as in claim 1 wherein a first resistor is connected in parallel to said first and second voltage triggered switch, said first and second inductor means, the primary of said pulse transformer and said first capacitor.

4. A second capacitor connected in parallel with said second voltage triggered switch and said second inductor, the primary of said pulse transformer and said first capacitor.

5. A rapid restrike starter as in claim 1 wherein a second resistor is connected in parallel 2 said second capacitor.

* * * * *